United States Patent [19]

Rowcliffe et al.

[11] Patent Number: 4,913,980

[45] Date of Patent: Apr. 3, 1990

[54] CORROSION RESISTANT COATINGS

[75] Inventors: David J. Rowcliffe, Stockholm, Sweden; Ibrahim M. Allam, Dhahran, Saudi Arabia; Paul J. Jorgensen, Cupertino, Calif.

[73] Assignee: S R I International, Menlo Park, Calif.

[21] Appl. No.: 185,087

[22] Filed: Apr. 22, 1988

Related U.S. Application Data

[63] Continuation-in-part of Ser. No. 325,504, Nov. 27, 1981, Pat. No. 4,483,720, and a continuation-in-part of Ser. No. 662,253, Oct. 17, 1984, abandoned, and a continuation-in-part of Ser. No. 662,252, Oct. 17, 1984, abandoned, and a continuation-in-part of Ser. No. 111,210, Oct. 21, 1987.

[51] Int. Cl.[4] ..... B32B 15/00

[52] U.S. Cl. ..... 428/632; 428/660; 428/661; 428/680; 428/681

[58] Field of Search ..... 428/632, 633, 660, 661, 428/680, 681, 469, 472, 472.1

[56] References Cited

U.S. PATENT DOCUMENTS

| | | | |
|---|---|---|---|
| 3,261,673 | 7/1966 | Wheildon, Jr. | 428/632 |
| 4,027,367 | 6/1977 | Rondeau | 428/660 |
| 4,252,867 | 2/1981 | Nemoto et al. | 428/660 |
| 4,425,411 | 1/1984 | Textor et al. | 428/472 |
| 4,483,720 | 11/1984 | Bartlett et al. | 148/6.3 |
| 4,645,715 | 2/1987 | Ovshinsky et al. | 428/469 |

FOREIGN PATENT DOCUMENTS

| | | | |
|---|---|---|---|
| 131184 | 6/1978 | German Democratic Rep. | 148/6.3 |
| 2106145 | 4/1983 | United Kingdom | 428/472 |

*Primary Examiner*—L. Dewayne Rutledge
*Assistant Examiner*—George Wyszomierski
*Attorney, Agent, or Firm*—Edward B. Gregg; Urban H. Faubion; John Y. Chen

[57] ABSTRACT

A method of protecting ferrous metal structures from oxidative attack in an aqueous, corrosive, oxidative environment by applying a thin, impervious coating of an oxide of titanium, zirconium, tantalum or niobium (or a mixture of two or more such oxides). The coating is applied as an alloy (preformed or form in situ) of the respective metal and a more noble metal such as nickel, cobalt, copper or iron and the alloy is preferably thermally oxidized under conditions to oxidize the titanium, zirconium and/or niobium without oxidizing the more noble metal, which serves to bind the oxide coating to the substrate. Alternatively the alloy may be applied, and then oxidized by the conditions of use.

12 Claims, 1 Drawing Sheet

CORROSION RESISTANT COATINGS

Figure 1:
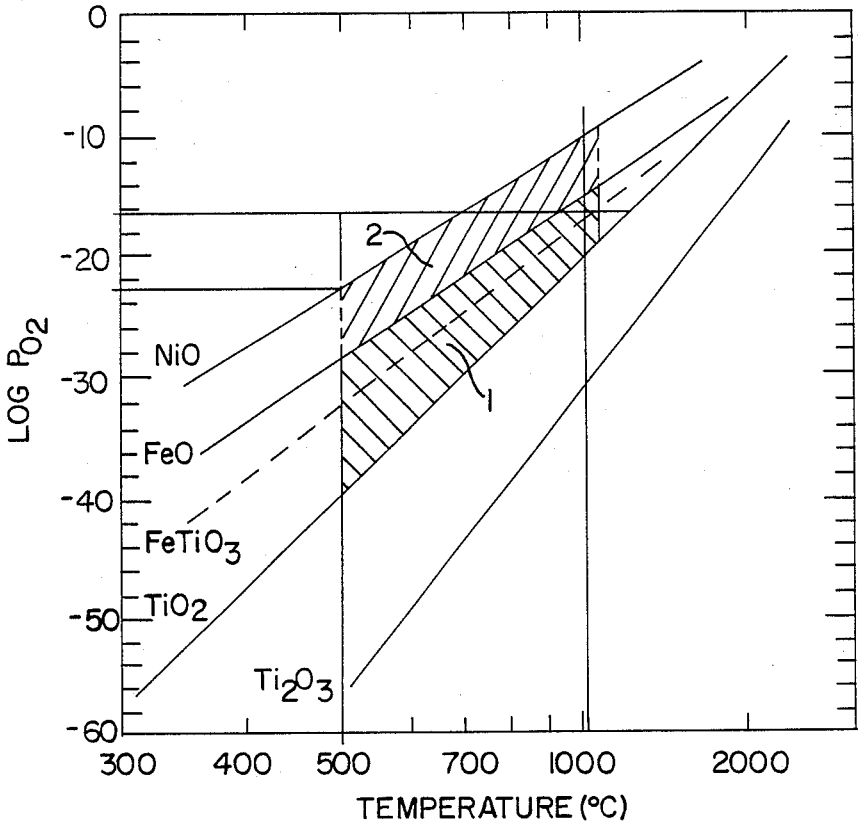

This application is a continuation-in-part of our copending applications as follows: Ser. No. 325,504, filed Nov. 27, 1981, entitled "PROCESS FOR APPLYING THERMAL BARRIER COATINGS TO METALS AND RESULTING PRODUCT", now U.S. Pat. No. 4,483,720; Ser. No. 662,253, filed Oct. 17, 1984, abandoned, entitled "PROCESS FOR APPLYING COATINGS TO METALS AND RESULTING PRODUCT"; Ser. No. 662,252, filed Oct. 17, 1984, abandoned, entitled "PROCESS FOR APPLYING HARD COATINGS AND THE LIKE TO METALS AND RESULTING PRODUCT" and Ser. No. 111,210, filed Oct. 21, 1987, pending entitled "PROCESS FOR APPLYING COATINGS TO METALS AND RESULTING PRODUCT."

This invention is related to procedures for inhibiting of corrosion of structural steel which is exposed to aqueous environments which are corrosive. Typical of such metals and conditions is the treatment of industrial waste water by oxidation with air in the presence of a catalyst to eliminate or reduce toxic components from the water. Such treatment is very corrosive to structural steel.

It has been the practice to use Hastalloy for equipment used in such processes but it is very expensive.

Titanium may be used but if applied as a melt, its high melting point and reactivity are a disadvantage. If it is applied by cladding its use is limited because cladding is difficult or impossible to apply to complex shapes.

It is known to provide oxide coatings for protection of alloys against oxidation at high temperatures and/or to provide thermal insulation of such alloys. See, for example, British Patent Nos. 1,439,947; 1,086,708 and 1,396,898.

Oxidation at high temperatures in, for example, a gas turbine is quite different from corrosion in an aqueous medium at lower temperatures. Low temperature corrosion in a highly corrosive aqueous medium does not require thick coatings but it does benefit by, if it does not require uniform, impervious coatings.

We have found that titanium dioxide, if properly applied to structural steel, will provide a high degree of resistance to corrosion in highly corrosiive aqueous media. Other metal oxides such as zirconium oxide, tantalum oxide or niobium oxide may be similarly applied with similar results. Mixture of two or more of these oxides may be used.

Examples of substrate metals to which titanium dioxide is applied are pressure vessel steels, carbon steels, tool steels, etc.

In the ensuing description the application of titanium dioxide is described. It will be understood that zirconium, tantalum or niobium oxide may be used and that mixtures of two or more oxides may be used as described above.

The titanium is applied in the form of an alloy with a metal such as iron, nickel or cobalt, preferably nickel, which serves to bond the titanium to the substrate metal. The alloy is preferably preformed, i.e., it is applied as an alloy of titanium with the bonding metal, but a mixture of finely divided titanium and binder metal may be applied and heated to form an alloy in situ.

Suitable binder metals include nickel, cobalt, copper and iron. Nickel is preferred.

The proportion of titanium (or substitute metal) and binder metal, represented by $M_1$ and $M_2$, respectively, may range from 90% to 10% of $M_1$, the balance being $M_2$. Preferably the proportion of $M_1$ exceeds 55%. Percentages throughout are weight percentages.

The alloy of $M_1$ and $M_2$ may be applied by dipping the metal substrate in the molten alloy, or the $M_1/M_2$ metal alloy in finely divided condition may be applied in the form of a slurry in a volatile solvent. Such slurries are described in U.S. Pat. No. 4,483,720 at Column 4, lines 15 to 36. Alternatively the alloy may be applied by plasma spraying, vapor deposition, or flame spraying. As stated the $M_1/M_2$ metals may be applied, e.g., by the slurry coating method, as a preformed alloy or as a mixture of the individual metals, and the alloy may be formed in situ by heating.

After a coating of alloy is applied to the substrate metal it is preferably annealed by heating. Then the annealed coating is subjected to selective oxidation at an elevated temperature, the partial pressure of oxygen, $p(O_2)$ and the temperature being such that the metal $M_1$ is oxidized but the bonding metal $M_2$ is not oxidized. The procedure described in U.S. Pat. No. 4,483,420 may be employed. This results in selective oxidation of $M_1$ and results in a coating, the outer layer of which is the oxide of $M_1$, e.g., $TiO_2$ bonded by an inner layer of $M_2$, e.g., nickel to the substrate metal and an intermediate interaction zone.

Alternatively the coating of alloy may be oxidized anodically, e.g., by an electrochemical process designed for the purpose or by the conditions of use. In the latter case, the metal with its coating of alloy is subjected in use to an oxidizing environment, and the metal $M_1$ will undergo oxidation.

That is to say, it may be sufficient to apply the alloy and then use the coated metal for the intended purpose, e.g., as a vessel, pipe or tube in an industrial process such as the treatment of industrial waste water by oxidation with air in the presence of a catalyst. This will expose the coating to oxidation which will convert Ti to $TiO_2$, thus forming a protective layer of the oxide.

It is preferred, however, to oxidize the titanium to titanium dioxide by selective thermal oxidation. Such oxidation will selectively oxidize the titanium and will drive the $M_2$ metal, also iron extracted from the substrate, inwards toward the substrate. A thin outer coating of $TiO_2$ can thus be applied which is free of the $M_2$ metal. Such a coating is preferred because it is less likely than a thick coating to fail or spall because of different thermal coefficients of expansion of the coating and the substrate. Such differences are less destructive in thin coatings than in thick coatings. Coatings of $M_1$ oxide not thicker than about 100 micrometers are preferred. Also the absence of the $M_2$ metal at the exposed surface is advantageous because it is subjected to attack by a corrosive environment. If $M_2$ is present at the exposed surface, this leaching out will result in a porous coating which is subject to further attack and to attack on the substrate metal.

It is preferred to use a eutectic or near-eutectic alloy as a coating material having a melting point below that of the substrate metal, thus avoiding melting or other destructive effect on the surface of the substrate an undesirable degree of migration of components of the substrate into the protective coating. Also eutectic alloys deposit, as they solidify, a solid phase of uniform composition.

Suitable oxidizing atmospheres are a $CO_2/CO$ mixture which at high temperatures undergoes the equilibrium reaction $$CO_2 \rightleftharpoons CO_2 + \tfrac{1}{2} O_2 \quad (1)$$

Also $H_2/H_2O$ mixtures which at high temperatures undergo the equilibrium reaction $$H_2O \rightleftharpoons H_2 + \tfrac{1}{2} O_2 \quad (2)$$

Preferably, however, an oxygen atmosphere is provided by using a noble gas such as argon containing a very small proportion of oxygen. This avoids production of undesirable hydrides.

As stated above, various methods of application of alloy coatings may be used. Slurry coating, by dipping, spraying or brushing has been found to be preferable, especially for large or complex shapes, e.g., the interior surfaces of tubes, pipes and tanks and reaction vessels.

Application of the alloy coating and annealing the coating are preferably carried out in an inert atmosphere such as de-oxidized argon.

If dip coating is employed, the metal is preferably heated before dipping to avoid or minimize chilling of the alloy. In dip coating immersion time is preferably long enough to apply a uniform, smooth coating but not so long as to extract a large amount of metal from the substrate.

The temperature used in selective thermal oxidation should be high enough to avoid oxidation of metals other than $M_1$.

Where coating is by the slurry method, the coated substrate is first heated to evaporate the solvent and to melt the $M_1/M_2$ alloy to form a continuous surface coating. Then the alloy coating is annealed and is selectively oxidized.

The surface to be coated is preferably cleaned before coating, e.g., by ultrasonic washing with acetone, then air drying, followed by immersing in HCl solution to remove surface oxides, then washing with de-ionized water.

In coating by dipping the substrate in a molten alloy, it is preferred to bring the temperature of the substrate to or close to that of the molten alloy. If the size of the substrate and the vessel in which the molten alloy is held during dipping permits, this may be done by holding the substrate over the molten alloy for a sufficient time to bring it up to or close to the temperature of the alloy. Such a procedure minimizes the extraction of metal from the substrate. In a typical instance the substrate was held above the molten alloy at 1500° for two hours, then dipped in the alloy for 15 seconds, then removed and held above the molten alloy for three seconds and redipped for 15 seconds.

The following examples will illustrate the practice of the invention. The temperatures are Celsius.

EXAMPLE 1.

Dip Coating Followed by Selective High Temperature Oxidation

Air is replaced by argon in a chamber which is closed except for gas ducts. The temperature is raised to 1000° or above. This chamber contains a molten eutectic alloy (Ti-28.5 Ni, i.e., 71.5% Ti and 28.5 Ni). Percentages are weight percentages throughout. The chamber is heated electrically. The specimen (A 515 carbon steel in one case, A 612 carbon steel in another case) was lowered slowly into the molten alloy, submerged 10 seconds, withdrawn and dipped similarly and withdrawn again. Annealing was carried out by holding the specimen in the chamber above the molten alloy.

The coated specimen was removed from the dipping chamber and placed in another chamber where it was exposed to an atmosphere of argon containing oxygen at a partial pressure of $10^{-16}$ atmospheres for five hours.

EXAMPLE 2.

Preferred Dipping Procedure

In dipping apparatus as described in Example 1, the specimen was held above a melt of a Ti-28.5 Ni alloy at 1150° for two hours, then dipped for 15 seconds, then removed and annealed above the melt for times up to one hour and then furnace cooled to room temperature. The oxygen partial pressure was maintained below $10^{-25}$ atmospheres.

Examination of a specimen thus coated revealed four distinct regions, in the following order: (1) the steel substrate; (2) a pearlite free zone; (3) an interaction zone and (4) the dip coated layer.

EXAMPLE 3.

Table 1 below sets forth the results of corrosion on two types of steel each coated with a Ti-Ni alloy. The letters "O" and "D" indicate, respectively, thermal oxidation of the coating and as dipped coatings. That is, the "O" coatings were dipped at 1150° C. and oxidized at 1000° C. for 20 hours at a $p(O_2)$ of $10^{-16}$ atmospheres, while the "D" coatings were dipped at 1150° C. but were otherwise untreated.

The aqueous test solutions were as follows:

(1) 0.01 N HCl+0.099 M NaCl
(2) 0.1 M $Na_2S_2O_3$ in neutral water
(3) 0.1 M $N_2S$+sulfur
(4) 0.1 M NaSCN in neutral water

TABLE 1

SUMMARY OF RESULTS OF ISOTHERMAL CORROSION TESTS ON COATED STEEL SAMPLES AT 270° C. FOR 100 HOURS

| Test Solution | Sample No. and Condition | Specific Wt. Change ($mg/cm^2$) | Comments |
|---|---|---|---|
| (1) HCl/KCl | A515-60A-D | −5.6 | Local spalling of oxide |
| | A515-65A-O | −0.29 | No visible damage |
| | A612-61A-D | +0.13 | Slight spalling of oxide |
| | A612-64A-O | −2.5 | Slight spalling of oxide |
| (2) $Na_2S_2O_3$ | A515-77A-D | +1.1 | No visible damage |
| | A515-66A-O | −0.36 | No visible damage |
| | A612-72A-D | +0.21 | No visible damage |
| | A612-68A-O | −0.95 | No visible damage |
| (3) $Na_2S$ + S | A515-74A-D | +0.60 | No visible damage |
| | A515-56A-O | +0.05 | No visible damage |
| | A612-79A-D | +1.4 | No visible damage |
| | A612-80A-O | −0.45 | No visible damage |

TABLE 1-continued

| SUMMARY OF RESULTS OF ISOTHERMAL CORROSION TESTS ON COATED STEEL SAMPLES AT 270° C. FOR 100 HOURS | | | |
|---|---|---|---|
| Test Solution | Sample No. and Condition | Specific Wt. Change ($mg/cm^2$) | Comments |
| (4) NaSCN | A515-75A-D | −12.8 | Spalling of thick region of coating |
| | A515-58A-O | −0.62 | Slight spalling of oxide |
| | A612-78A-D | −7.5 | Local spalling of oxide |
| | A612-81A-O | +0.95 | Slight spalling of oxide |

D = Dipped at 1150° C.
O = Dipped at 1150° C. and oxidized at 1000° for 20 hr at $p(O_2)$ of $10^{-16}$ atm

EXAMPLE 4.

Cyclical corrosive tests were carried out with similar coated steel specimens using the HCl/KCl solution of Example 3 and also using solution at a pH of 10.5. The test involved subjecting the coated specimens to 20 cycles between 270° and 100° C. in an autoclave. The heating part of each cycle (from 100° C. to 270° C.) took approximately 30 minutes and the cooling part of the cycle (initiated by switching off the source of heat) was approximately five hours. Results are set forth in Table 2.

TABLE 2

| SUMMARY OF CYCLIC CORROSION TESTS ON COATED STEEL SAMPLES | | | |
|---|---|---|---|
| Test Solution | Sample No. and Condition | Specific Wt. Change ($mg/cm^2$) | Comments |
| (1) HCl/KCl | A515-89A-D | −2.03 | No visible damage |
| | A515-88A-O | | No visible damage |
| | A612-87A-D | | Loss of coating |
| | A612-86A-O | | Loss of coating |
| (5) $NH_4OH$ | A515-84A-D | −0.06 | No visible damage |
| | A515-83A-O | | Some cracks |
| | A612-85A-D | | No visible damage |
| | A612-82A-O | | No visible damage |

D = Dipped at 1150° C.
O = Dipped at 1150° C. and oxidized at 1000° C. for 20 hours at $p(O_2)$ of $10^{-16}$ atm As noted above, in the selective thermal oxidation of the metal $M_1$ in the coating, a temperature and an oxygen partial pressure should be selected which will result in formation of an oxide of only the metal $M_1$. Referring to the single FIGURE of the drawings, the stabilities of the oxides of nickel (NiO), iron (FeO) and titanium ($TiO_2$) are shown. Ordinates represent the logarithm of the oxygen pressure and abscissa represent temperatures. By way of example, assuming the absence of iron in the coating of a titanium/nickel alloy and assuming that no other more noble metal, such as iron is present in the coating, at 500° C. an oxygen partial pressure less than about $10^{-25}$ atmospheres should ensure that no nickel oxide forms and that the only oxide formed will be $TiO_2$, whereas at 1000° C. an oxygen partial pressure of about $10^{-16}$ atmospheres will suffice. The curves of the FIGURE are based on available thermodynamic data and are intended to serve as a rough guide. The curve for FeO should also be considered if iron is likely to be present, e.g., due to extraction from the substrate by the coating alloy before it has solidified. Other oxides such as $FeTiO_3$ may also be present. Nevertheless, the curves of the FIGURE are useful as guides. Choice of a temperature and $p(O_2)$ should be well within the limits indicated by the FIGURE.

It will therefore be apparent that a new and useful protective coating has been provided for metals, e.g., structural steels, which is resistant to corrosion in a corrosive, oxidative environment, and that a new and useful method of producing such coatings has been provided.

We claim:

1. A metal structure exposed to a corrosive aqueous liquid, such structure comprising a substrate metal forming a major part of the structure and which is exposed to and in the absence of a protective coating would be corroded by such liquid, such substrate metal being coated in the area so exposed by a dense, uniform, adherent, nonporous coating of an oxide of at least one of the metals titanium, zirconium, tantalum and niobium, such oxide having been formed by oxidation in situ of a coating on the substrate metal of an alloy of such metal with a more noble metal which remains unoxidized during such in situ oxidation, such oxide coating providing a barrier to penetration by such liquid to the substrate metal, such more noble, unoxidized metal serving to bond the oxide coating firmly to the substrate metal.

2. The structure of claim 1 wherein the substrate metal is a ferrous alloy.

3. The structure of claim 2 wherein the substrate metal is structural steel and the structure is used in oxidative treatment of polluted industrial water.

4. The structure of claim 3 wherein the metal oxide if $TiO_2$.

5. The structure of claim 4 wherein the $TiO_2$ forms a coating not substantially thicker than about 100 micrometers and is substantially free of the more noble metal.

6. The structure of claim 5 wherein said more noble metal is nickel.

7. A metal structure which is exposed during use to a corrosive aqueous liquid, such structure comprising a substrate metal forming a major part of the structure and which in use is exposed to and in the absence of a protective coating would be corroded by such liquid, such substrate metal being coated in the area so exposed by a dense, uniform, adherent, non-porous coating, such coating being an oxidized alloy of (1) a metal $M_1$ which is at least one of the metals titanium, zirconium, tantalum and niobium and (2) a metal $M_2$ which is more noble than $M_1$, $M_1$ and $M_2$ being selected such that when the coating of alloy is exposed to a high temperature and an atmosphere having a low partial pressure of oxygen it forms a dense, uniform adherent, non-porous coating in which the $M_1$ metal forms a stable oxide and the $M_2$ metal does not form a stable oxide, the $M_2$ metal serving to bond the alloy and its oxidation product to the substrate metal, said alloy being applied by dipping the substrate metal in the molten alloy or by applying a slurry of particles of the alloy in a volatile liquid and evaporating the liquid and then fusing the particles of alloy, said coating having been exposed to a high temperature and an atmosphere having a low partial pressure of oxygen whereby the $M_1$ metal is oxidized and the $M_2$ metal is unoxidized and serves to bond the coating to the substrate metal.

8. The metal structure of claim 7 wherein the metal substrate is a ferrous alloy.

9. The metal structure of claim 8 wherein the substrate metal is structural steel.

10. The metal structure of claim 9 wherein the metal $M_1$ is titanium.

11. The metal structure of claim 10 wherein the metal $M_2$ is nickel.

12. The metal structure of any of claims 7 to 11 in which the alloy coating has been annealed prior to oxidation.

* * * * *